US008282316B2

(12) United States Patent
Breivik

(10) Patent No.: US 8,282,316 B2
(45) Date of Patent: Oct. 9, 2012

(54) METHOD AND ASSEMBLY FOR INSTALLING OILFIELD EQUIPMENT AT THE WATER BOTTOM

(75) Inventor: Harald Wahl Breivik, Oslo (NO)

(73) Assignee: shell Oil Company, Houston, TX (US)

( * ) Notice: Subject to any disclaimer, the term of this patent is extended or adjusted under 35 U.S.C. 154(b) by 849 days.

(21) Appl. No.: 11/920,897

(22) PCT Filed: May 24, 2006

(86) PCT No.: PCT/EP2006/062558

§ 371 (c)(1),
(2), (4) Date: Nov. 21, 2007

(87) PCT Pub. No.: WO2006/125791

PCT Pub. Date: Nov. 30, 2006

(65) Prior Publication Data

US 2009/0232605 A1 Sep. 17, 2009

(30) Foreign Application Priority Data

May 27, 2005 (EP) ..... 05104538

(51) Int. Cl.
*E02D 29/00* (2006.01)

(52) U.S. Cl. ..... 405/203; 405/191; 405/205

(58) Field of Classification Search ..... 405/196, 405/190, 191, 203, 205; 114/44–54, 256, 114/257; 441/3–5; 166/350, 360
See application file for complete search history.

(56) References Cited

U.S. PATENT DOCUMENTS

| | | | | |
|---|---|---|---|---|
| 1,393,894 | A * | 10/1921 | McGill | 114/51 |
| 5,069,580 | A * | 12/1991 | Herwig et al. | 405/191 |
| 5,190,107 | A * | 3/1993 | Langner et al. | 166/355 |
| 6,488,446 | B1 * | 12/2002 | Riemers | 405/203 |
| 6,935,262 | B2 * | 8/2005 | Roodenburg et al. | 114/258 |

FOREIGN PATENT DOCUMENTS

| | | |
|---|---|---|
| WO | WO 0066871 | 11/2000 |
| WO | WO 03100207 | 12/2003 |

* cited by examiner

*Primary Examiner* — John Kreck
*Assistant Examiner* — Sean Andrish

(57) ABSTRACT

Subsea oilfield equipment (2), such as an oil and/or gas production template, is installed at the water bottom (16) by means of a submerged installation vessel (1) from which hoisting lines (3A, 3B) are deployed to support the equipment during the installation procedure, which lines (3A,3B) are reeled from at least one hoisting line reeling winch (3A,3B) mounted at the submerged installation vessel (1) to lower the equipment (2) at a desired speed and in a substantially horizontal position onto the water bottom (16).

8 Claims, 2 Drawing Sheets

10
13
12
14
16
23
15
4A
1
11
21
22B
17
22A
20A
15A
3A
5A
6A
2
7B
7A
18A
18B
16

METHOD AND ASSEMBLY FOR INSTALLING OILFIELD EQUIPMENT AT THE WATER BOTTOM

The present application claims priority of European Patent Applications No. 05104538.3 filed 27 May 2005.

FIELD OF THE INVENTION

The invention relates to a method and assembly for installing oilfield equipment at water bottom.

BACKGROUND OF THE INVENTION

It is known from U.S. Pat. No. 5,190,107 to install oilfield equipment at the water bottom by means of a submerged buoy from which the equipment is suspended by a lifting line and which is connected to a work vessel by a J-shaped catenary chain, that compensates for heave motions of the floating work vessel.

The known heave compensated submerged buoy can be used to install relatively small subsea oilfield equipment, such as valves of subsea pipelines and modules of subsea well templates, and the installation may be monitored by a camera on a Remotely Operated Vehicle (ROV) and assisted by a robotic arm mounted on the ROV.

In the known method the equipment is lowered to the water bottom by paying out the J-shaped catenary chain from a winch at the work vessel so that the chain pulls down the submerged buoy.

A disadvantage of the known method is that there is an upper practical limit of the weight of the equipment to be installed at the water bottom. The weight of the equipment determines the size and buoyancy of the buoy and after installation of the equipment the J-shaped catenary chain has to be paid out further until the lifting line is slackened to prevent the buoy from accelerating to surface when the installed equipment is released from the buoy. This implies that if a large piece of equipment is to be installed at the water bottom the submerged buoy has to be connected to the equipment by a long lifting line. The required increased length of the lifting line reduces the depth at which the buoy can be submerged during the installation procedure and results in an imprecise positioning of the equipment at the water bottom.

It is an object of the present invention to alleviate this disadvantage and to provide a method and assembly which is suitable for installing large pieces of underwater oilfield equipment, such as a subsea template of several thousand metric tones, in a more accurate and quick manner than the known method.

SUMMARY OF THE INVENTION

In accordance with the invention there is provided a method of installing oilfield equipment at the water bottom by means of an installation vessel from which a number of hoisting lines are deployed to support the equipment during the installation procedure, wherein the vessel is submerged during the installation procedure and at least one hoisting line is during at least part of the installation procedure reeled from a hoisting line reeling winch mounted at the installation vessel.

The installation vessel may be submerged to a depth of more than 100 meters below the water surface, where the impact of waves and/or swell is reduced such that vertical and/or horizontal oscillating movements of the submerged vessel resulting from waves and/or swell have an amplitude of less than a meter during installation.

The oilfield equipment may be a piece of subsea oil and/or gas production equipment having a weight of several thousand metric tonnes and may be suspended from the submerged installation vessel by a plurality of hoisting lines that are connected to a plurality of hoisting line winches that are mounted on the installation vessel.

To precisely lower the equipment at a target position at the water bottom it is preferred that the submerged installation vessel is connected to a first floating work vessel by a J-shaped catenary chain and to a second floating work vessel by a towing cable to which a clump weight is connected, such that a lower section of the towing cable extends in a substantially horizontal direction between the clump weight and the submerged installation vessel.

The invention also provides an assembly of an installation vessel, oilfield equipment, a J-shaped catenary chain for depth control of the installation vessel and a number of hoisting lines extending between the installation vessel and the oilfield equipment, wherein the installation vessel is adapted to be submerged during the procedure of installing the oilfield and at least one hoisting line extends from a hoisting line winch at the deck of the installation vessel through a tubular hoisting line channel, which extends from the deck to the bottom of the installation vessel.

A submergible installation vessel for use in the assembly according to the invention comprises:

- a number of hoisting line winches;
- a number of flotation compartments that are filled with syntactic foam and that are located adjacent to an upper deck of the vessel;
- a number of ballast tanks that are located adjacent to the bottom of the vessel; and
- water inlet and/or air outlet valves for filling the ballast tanks with water during at least part of the oilfield equipment installation procedure.

It is preferred that the submergible installation vessel has substantially parallel side walls and rounded end walls, hoisting line winches that are mounted at the deck of or inside the vessel and a pair of substantially vertical hoisting line channels or winch areas that are arranged at substantially equal distances from the side walls of the installation vessel. The point where the hoisting line leaves the installation vessel may be adjusted according to the shape of the equipment to be installed.

The invention also provides oilfield equipment for use in the assembly according to the invention, which has a weight of several hundred or thousand metric tones and comprises oil and/or gas production facilities that are adapted to be used underwater and which comprises a number of hoisting points that can be secured to the hoisting lines.

Optionally the oilfield equipment comprises a template with a number of cup-shaped suction piles for anchoring the template to the water bottom, and pumps for discharging water from the interior of the cup shaped suction piles during at least part of the procedure of installing the oilfield equipment at the water bottom.

These and other features, advantages and embodiments of the method and assembly according to the invention are described in the accompanying claims, abstract and the following detailed description of a preferred embodiment in which reference is made to the accompanying drawings.

DETAILED DESCRIPTION OF THE DRAWINGS

Figure 1:
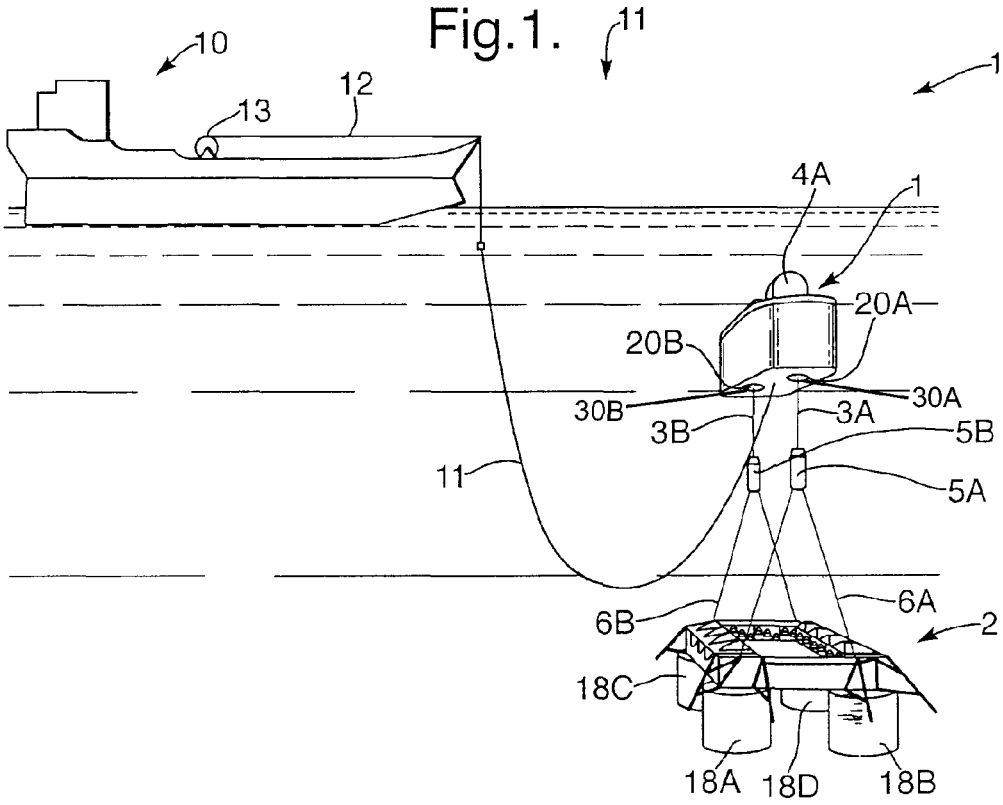
FIG. 1 is a schematic three-dimensional view of a subsea template which is lowered onto the seabed by means of a submerged installation vessel in accordance with the invention.
Figure 2:
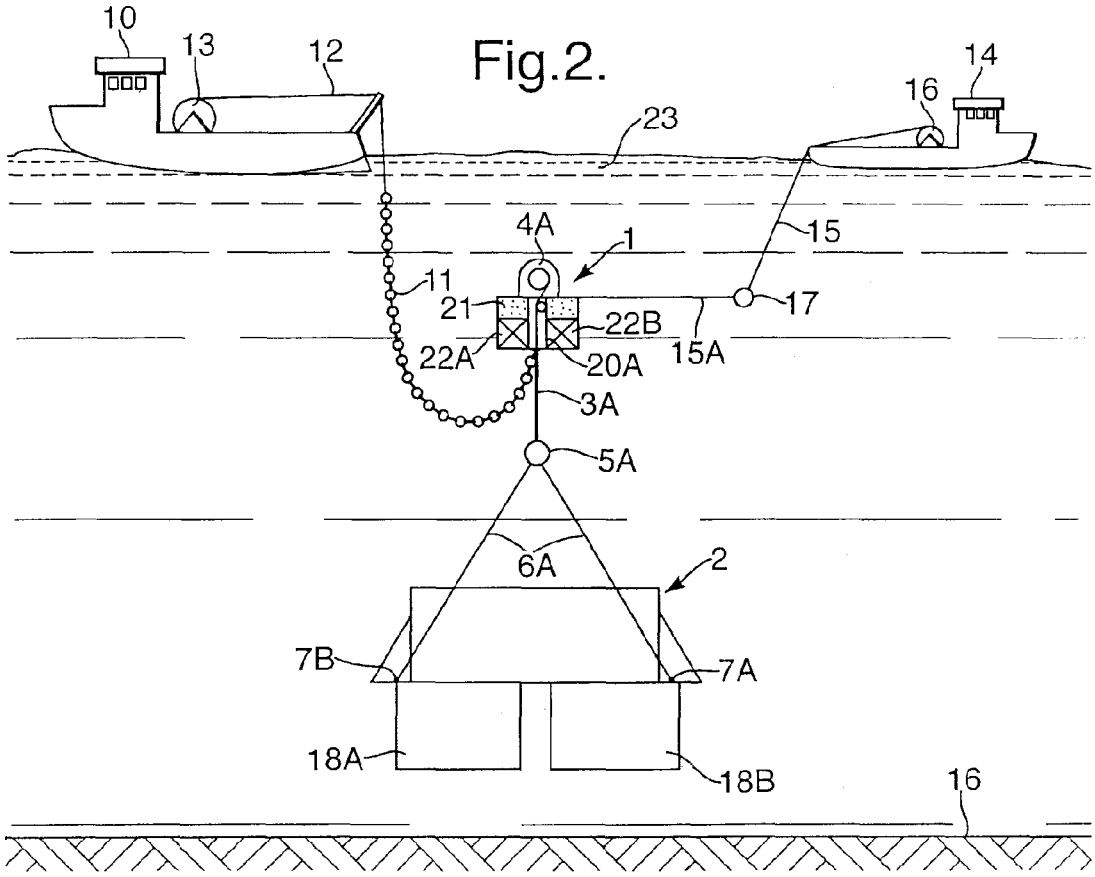
FIG. 2 is a schematic two-dimensional view of the assembly of FIG. 1 and illustrates how the submerged vessel is maneuvered in a desired horizontal and vertical position by two floating work vessels.

FIGS. 1 and 2 show a system 100 which includes a submerged installation vessel 1 from which a subsea template 2 is suspended by two hoisting cables 3A and 3B that are connected to a pair of winches 8A and 8B provided by reeling drums 4A and 4B at the deck of the vessel 1. The hoisting cables 3A and 3B carry a pair of hoisting hooks 5A and 5B and a pair of inverse V-shaped hoisting lines 6A and 6B that are connected to four hoisting eyes 7A-7D that are located near the upper corners of the template 2.

The submerged installation vessel 1 is connected to a first work vessel 10 by a J-shaped catenary chain 11 that is suspended from a hoisting cable 12, which is connected to a reeling drum 13 at the deck of the vessel 10.

FIG. 2 shows that the submerged installation vessel 1 is also connected to a second work vessel 14 by a towing cable 15 that is connected to a reeling drum 16. A clump weight 17 is connected to the towing cable 15, such that a lower section 15A of the cable extends in a substantially horizontal direction between the clump weight 17 and the submerged installation vessel 1. The lower section 15A of the towing cable pulls the submerged installation vessel 1 away from the first installation vessel 10 so that the J-shaped chain 11 has a desired smoothly curved shape and that the subsea template 2 can be maneuvered accurately above the targeted installation point at the water bottom 16. The use of two installation vessels 10 and 14 and two laterally spaced hoisting lines 3A and 3B inhibits rotation in a horizontal plane of the submerged installation vessel 1 and the template 2 during the installation procedure.

The connection of the hoisting lines 3A and 3B to reeling drums 4A and 4B at the deck of the submerged installation vessel 1 permits a controlled descent of the template 2 onto the water bottom 16 such that the template 2 is in a substantially horizontal position when it hits the water bottom 16 and when it is secured to the water bottom by activating a set of four suction piles 18A-D that are located near the four corners of the template 2.

As illustrated in FIG. 1 the submerged installation vessel 1 has an elongate streamlined shape with parallel side walls and rounded front and rear walls and a pair of moonpools 20A, 20B equipped with hoisting line guide means through which the cables 3A and 3B extend and above which the reeling drums 4A and 4B are mounted at the deck of the vessel 1.

FIG. 2 illustrates that an upper circumference of the submerged installation vessel 1 is filled with a syntactic foam 21 and that a mid and lower section of said hull comprises several ballast tanks 22A and 22B that are filled with air during tow out of the installation vessel 1 from an inshore construction site, such as a fjord, to the offshore location where the template 2 is to be installed. During tow out the installation vessel 1 floats at the water surface 23. When the installation vessel 1 has reached the offshore location where the template is to be installed then air is evacuated from the ballast tanks 22A and 22B and the tanks are filled with water such that the installation vessel is slightly positive buoyant and still floating at the surface. Then the catenary chain is paid out from the support vessel such that the chain adds on mass to the installation vessel 1 and the installation vessel 1 is submerged and sinks to a desired depth of about 100 to 150 meters, well below the wave affected zone near the water surface 23.

When the submerged installation vessel 1 has reached the desired depth it is held in a substantially stationary horizontal and vertical position between and below the two installation vessels 10 and 14 by means of the J-shaped catenary chain 11 and the towing line 15 and then the two reeling drums 4A and 4B are activated to pay out the hoisting lines 3A and 3B so that the template is lowered at a controlled speed and in a substantially horizontal position onto the water bottom 16.

That which is claimed is:

1. A method of installing oilfield equipment at a water bottom comprising: providing a first floating work vessel, providing a second floating work vessel, providing an installation vessel having a deck from which one or more hoisting lines are deployed to support the equipment, connecting the first floating work vessel to the installation vessel with one line, connecting the second floating work vessel to the installation vessel with one line, submerging the installation vessel and at least one of the one or more hoisting lines reeled from a hoisting line reeling winch mounted at the installation vessel, and installing the oilfield equipment wherein the line connecting the submerged installation vessel to the first floating work vessel is a J-shaped catenary chain and the line connecting the submerged installation vessel to the second floating work vessel is a towing cable to which a clump weight is connected, such that a lower section of the towing cable extends in a substantially horizontal direction between the clump weight and the submerged installation vessel.

2. The method of claim 1, wherein the installation vessel is submerged to a depth at which the impact of waves or swell is reduced such that vertical or horizontal oscillating movements of the submerged installation vessel resulting from the waves or swell have an amplitude of less than a meter during installation.

3. The method of claim 1, wherein the installation vessel is submerged to a depth of more than one hundred meters below the water surface during the installation procedure.

4. The method of claim 1, wherein the oilfield equipment is a piece of subsea oil or gas production equipment having a weight of several hundred metric tonnes and is suspended from the submerged installation vessel by the one or more hoisting lines that are connected to the one or more hoisting line reeling winches that are mounted on the installation vessel.

5. The method of claim 4, wherein the subsea oil or gas production equipment comprises subsea oil or gas production facilities that are connectable to one or more underwater oil or gas production wells, and that comprise at least one of oil or gas production conduits, valves, pumps, or separation, reinjection, treatment or production metering equipment.

6. The method of claim 4, wherein the oilfield equipment comprises a template which is anchored to the water bottom by means of a number of cup shaped suction piles comprising lower edges, from which water is evacuated after the lower edges of the suction piles have reached the water bottom, while the hoisting lines still exert a lifting force to the template.

7. The method of claim 4, wherein the one or more hoisting line winches are mounted at the deck of the installation vessel and the one or more hoisting lines extend through tubular hoisting line channels that are equipped with hoisting line guide means that are located adjacent to a bottom of the installation vessel.

8. The method of claim 7, wherein the installation vessel has substantially parallel side walls and rounded end walls and the tubular hoisting channels are a pair of substantially vertically oriented tubular hoisting line channels that are arranged at substantially equal distances from the side walls of the installation vessel.

* * * * *